US007407452B1

(12) United States Patent
Gawthrop

(10) Patent No.: US 7,407,452 B1
(45) Date of Patent: Aug. 5, 2008

(54) SOCCER TARGETING AID

(76) Inventor: Phillip Gawthrop, 4769 Highway 58, Chattanooga, TN (US) 37416

( * ) Notice: Subject to any disclaimer, the term of this patent is extended or adjusted under 35 U.S.C. 154(b) by 262 days.

(21) Appl. No.: 11/289,982

(22) Filed: Nov. 30, 2005

Related U.S. Application Data

(60) Provisional application No. 60/632,214, filed on Dec. 1, 2004.

(51) Int. Cl.
*A63B 69/00* (2006.01)

(52) U.S. Cl. ..... 473/446; 473/422

(58) Field of Classification Search ..... 273/161, 273/410; 473/161, 470, 471, 415, 416, 456, 473/446, 422; 24/300, 301, 298–299; 119/793
See application file for complete search history.

(56) References Cited

U.S. PATENT DOCUMENTS 4,083,559 A 4/1978 Owen, Jr.
4,948,147 A 8/1990 Pallanca
5,181,725 A * 1/1993 Leras et al. ..... 473/446
5,253,393 A * 10/1993 Levin ..... 24/301
5,351,367 A * 10/1994 Kennedy et al. ..... 24/129 R
5,634,640 A * 6/1997 McCarrel ..... 473/446
6,068,488 A 5/2000 Sinsheimer et al.
6,264,572 B1 7/2001 Matheson et al.
6,389,655 B2 * 5/2002 Libecco ..... 24/300
6,402,641 B1 * 6/2002 Lee ..... 473/446
6,695,724 B2 2/2004 Birss

* cited by examiner

*Primary Examiner*—Gene Kim
*Assistant Examiner*—M Chambers
(74) *Attorney, Agent, or Firm*—Stephen J. Stark; Miller & Martin PLLC

(57) ABSTRACT

A targeting aid for use with goals characterized by opposing uprights and a crossbar has a first connector connected to the crossbar. A support extends rearwardly and downwardly relative to the first connector and connects to a second connector behind the goal plane defined by the uprights and the crossbar. From the support a target is provided which is preferably elevationally adjustable and spaced by a member from the support. By spacing the target within the confines of the goal (i.e., rearward of the goal plane) it is not in a position to be inadvertently contacted by a goal keeper.

19 Claims, 2 Drawing Sheets

SOCCER TARGETING AID

CLAIM OF PRIORITY

This application claims the benefit of U.S. Provisional Patent Application No. 60/632,214 filed Dec. 1, 2004.

FIELD OF THE INVENTION

The present invention relates to an aid for use in practicing or playing soccer, and more specifically, to a targeting aid for use in assisting a soccer player in accurately targeting locations within a soccer goal for placement of the soccer ball.

BACKGROUND OF THE INVENTION

Description of Related Art

U.S. Pat. Nos. 6,264,572 and 4,948,147 show various structures which are designed to prevent a ball from passing into a net at selected portions of the goal. Specifically, there are "targets" which allow the passage of a ball or hockey puck through the net only at selected portions of the net due to the obstructions such as barrier 4, or nets, 11,12.

U.S. Pat. No. 6,068,488 shows a training device which provides a target in the form of disk 21. Functionally, this design appears to be the exact opposite of the cutout designs of U.S. Pat. Nos. 4,948,147 and 6,264,572. This target is located in the plane of the goal (i.e., the "goal plane") when installed and would be hit as the ball crosses the goal line.

Some innovators have recognized a need to provide targets which are moveable relative the net to provide a fixed position for addressing a ball or puck at a net as shown in U.S. Pat. Nos. 5,634,640, 6,402,641 and 6,695,724. However, in each of these references the targets are connected to or supported by the uprights define the entrance to the goal. Thus, the targets are in the plane of the entrance of the goal. Therefore, if a goal keeper were standing at the entrance, it is possible that the ability for the goal keeper to prevent balls from breaking the plane of the goal might be impeded by the location of the targets.

U.S. Pat. No. 4,083,559 is a training device which is not used as a goal. A user can view his or her movements on a mirror as a ball is projected towards the mirror target. The legs 1 in this disclosure form inverted V's which necessarily angle the front legs so that a traditional perpendicular opening defining a goal plane is not formed perpendicular to the playing field (i.e., there is no goal plane and there is no goal line). These front legs are utilized to tie cords 13 to affect the angle of the mirror 8 relative to a user. Accordingly, the legs of 1 must be angled in this manner for this training device to work as shown and described.

Finally, U.S. Pat. No. 5,181,725 shows a soccer shooting training target 21 which includes a plurality of flaps 32,40 and 48 which hang over openings 31,39 and 47. When a ball strikes the appropriate flap, the flap deflects to allow the ball to pass through the aperture in the target 21. It is anticipated that the target 21 will hang in a vertical position. The description of the preferred embodiment describes the use of stakes 56 on a windy day driven into the playing field 20 "to hold the soccer shooting training target in a vertical position." This device is somewhat akin to the training aids shown in U.S. Pat. Nos. 6,264,572 and 4,948,147.

A perceived disadvantage of all of the prior art is none of the targets provide an easy ability to retain the target in position while utilizing a goalie (i.e., the goalie cannot pass directly underneath the cross bar along the goal plane and goal line without coming into contact with one of the prior art targets). Accordingly, an improved soccer target system is believed to be necessary.

SUMMARY OF THE INVENTION

It is an object of the present invention to provide a soccer targeting aid which preferably does not interfere with the goal plane.

It is another object of the present invention to provide a soccer targeting device which provides a support extending from a cross bar down toward a rear portion of the net with targets connected thereto with the targets located behind the goal plane.

It is another object of the present invention to provide a soccer targeting device with targets resiliently suspended from a support in some embodiments.

It is another object of the present invention to provide a soccer targeting device having targets which are adjustable in elevation in some embodiments.

It is another object of the present invention to provide in at least some embodiments three-dimensional targets connected to a support.

It is another object of the present invention to provide a soccer training device which is preferably storable in a compact fashion and be easily installed on an existing soccer goal.

Accordingly, a soccer training device of the presently preferred embodiment of the present invention includes a support which is connectible with a connector to a top cross bar between the uprights of a goal. At a first end of the support, the connector may be a hook, a loop or other suitable connector, which is attached to the upper end of the support and the goal structure (i.e., such as the top cross bar). The lower end of the support is preferably connected to a back crossbar that runs along the ground in some goal embodiments or to the ground itself toward a rear portion of the net. In this way, the support is angularly positioned back into the net. From the support, it is envisioned that at least one and preferably a plurality of targets are suspended from elastic members which are connected at attachments. The connectors are preferably adjustably positioned along the support to locate the target at an appropriate elevation. The targets may be three-dimensional targets, two-dimensional targets or even be branded with logos. The targets are preferably completely located within the body of the goal (i.e., behind the goal plane) so that they do not obscure the travel of a goal tender intermediate the cross bar and the uprights along the goal plane which the targets provide a visual reference for which an individual may direct a ball.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1:
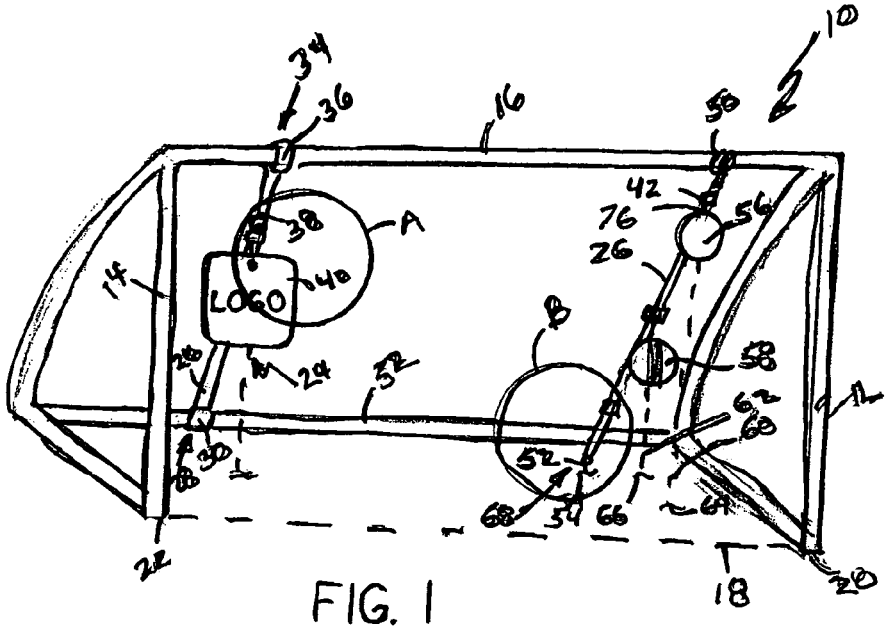
FIG. 1 is a front prospective view of a goal having two embodiments of the presently preferred invention installed thereon.
Figure 2:
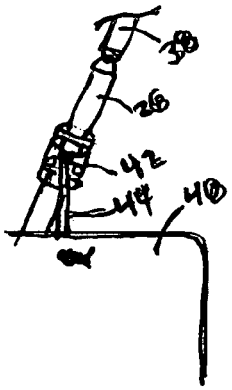
FIG. 2 is a close up of a portion of the first embodiment shown to the left in FIG. 1 showing an attachment of a target to a support.

FIG. 1 shows a goal 10 illustrated as a soccer goal. Although this soccer goal is a presently preferred structure, it will be understood to one skilled in the art that there are various soccer goal configurations as well as other goal configurations such as hockey goals, lacrosse goals, etc., that provide an opposing uprights 12,14 and a cross bar 16 which are located in a goal plane including a goal line 18. When a ball or puck crosses the goal plane, then a score has occurred in many sporting events including soccer, hockey, lacrosse, etc. The dotted goal line 18 is illustrated connecting the bases 20,22 of the uprights 12,14.

In the prior art, a number of targets were hung and obscure portions of the goal plane as they are hung from upright to upright or otherwise. As explained above in the description of related art, this is believed to hinder a goal keeper from being able to adequately defend the goal in some circumstances.

FIG. 1 shows two embodiments of the present invention. The first embodiment 24 is characterized by a support 26 in the form of a web strapping material. It is also possible that the support 26 could be a rigid support, but by providing a web fabric or rope type material, the length of the support 26 may be easily adjusted as will be described in reference to FIG. 3 to accommodate a variety of goal sizes. A connector may be utilized to connect the bottom end 28 of the support 26 to a base 32 of the goal 10 if so equipped.

Numerous connectors as known in the art may be utilized, in fact, the support 26 may loop about the base 32 and connect back to itself thereby forming the connector 30. Other alternative connectors 30 as known in the art could also be utilized.

A top portion 34 of the support 26 is preferably provided with a hook 36 used as a top connector which is preferably a rigid member which can be grabbed at extension 38 and then placed about the cross bar 16. For some shorter individuals, such as children, placing the support on in a standard soccer goal (which could be as high as eight feet) the extension 38 is helpful to assist in placing a hook 36 over the cross bar 16. It is anticipated that the hook 36 will be connected to the cross bar 16 first and then the bottom portion 28 connected to the connector 30 when installing the 28,24. Other configurations for a top connector could include a loop 50 as shown in the alternative embodiment shown to the right in FIG. 1.

In the first preferred embodiment, the target 40 is elevationally adjustable by sliding attachment 42 relative to support 26. There are numerous clamps, connectors and other devices known in the art which can be utilized to provide a suitable amount of friction of the attachment 42 relative to the support 26 to retain the target 40 in a desired position while also allowing the attachment 42 to be positioned relative to the support when so desired. Some attachments may lock, others may not. Connected to the attachment 42 is preferably an elastic member 44 which is downwardly extending parallel to the uprights 12,14. This elastic member 44 provides resilience and allows the target 40 to be displaced when struck by an object.

As seen in FIG. 1, on the front of the target 40 is preferably a location for a logo such as for advertisement, trademarks, or other identifying material. This embodiment illustrates a two-dimensional target 40, however, as will be explained, other targets 40 may also be utilized which are three-dimensional in nature.

As can be seen with reference to the second preferred embodiment in FIG. 1, the support 26 connects an upper cross bar 16 to the ground within a goal 10. Spike 52 is illustrated as inserted into the ground 54 behind the goal line 18. By connecting it in this manner with a substantial linear support 26 or other configuration, targets 56,58 may be supported within the confines of the goal 10 such that at least a portion of the targets 56,58 if not all of the targets 56,58, are located behind the goal line 18 (i.e., they do not intersect the goal plane as defined above).

As can be seen by the dotted lines 60,62 extending downwardly from the targets 56,58 and the locations 64,66 extending perpendicular to the ground from the targets 56,58, the targets 56,58 are located within the confines of the goal 10 so that a target placed at the ground at location 64,66 would not cross the goal line 18 or come in contact with the goal plane.

In the embodiment shown to the right in FIG. 1, the support 26 has a loop 50 which may be attached to cross bar 16 by tossing the support 26 partially over the cross bar 16 and then inserting the bottom end 68 through the loop 50 and pulling tight. Of course, a weighted line could also be attached to portions of the support 26 especially at the loop 50 itself so that the loop 50 may be relatively easily disengaged by pulling the weighted line when the opposite end 68 is not attached to the ground as illustrated so that the support 26 may be relatively easily disengaged from the cross bar 16 for storage after use. Other disengagements could also be employed.

Figure 3:
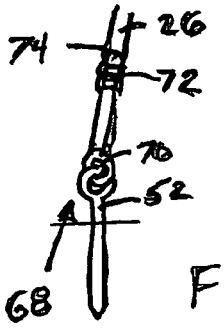
FIG. 3 shows a close up of a bottom end of the support connected to a stake.

The bottom end 68 of the support 26 is illustrated in greater detail in FIG. 3. A ring 70 is illustrated and connected to the spike 52 but other connection mechanisms may also be utilized. FIG. 3 illustrates that the support 26 is connected with a link 72 so the support 26 may be tightened relative to the spike 52 or connector 30 as shown in the first preferred embodiment shown in FIG. 1. Thus, by adjusting the length of the support 26, various height goals 10 can be accommodated with this design. Basically, the free end 74 is pulled away from the bottom end 68 as would be understood by one skilled in the art thereby pulling a portion of the support 26 through the ring 70 to shorten the support 20.

Figure 4:
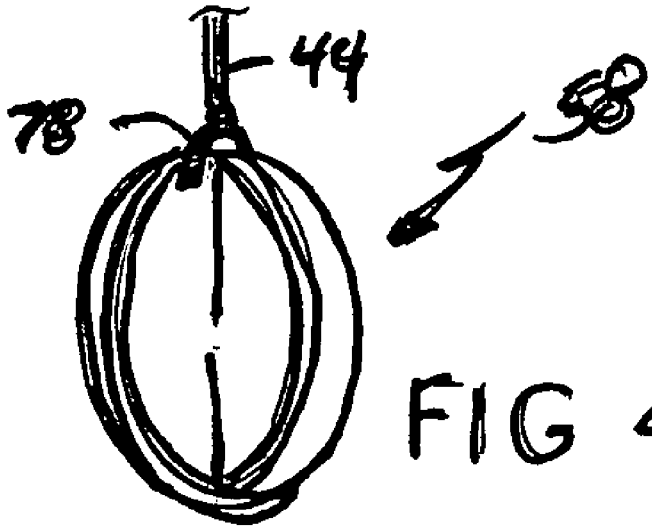
FIG. 4 shows an alternative of a first preferred embodiment of a target as shown on the second preferred embodiment shown on the bottom right in FIG. 1.

FIG. 4 shows a detailed view of two-dimensional target 58. Target 56 shown in FIG. 1 may be a two-dimensional disk or a three-dimensional ball or other three-dimensional shape. A ball shaped target can be formed using the two dimensional target 58 by placing a bag (not shown) on the structure about target 58. The bag (not shown) could provide a location for a logo as is done on target 40. It may, or may not, be connected by elastic member 44. It may be connected by rope member 76 or non-resilient rope member 76 and/or directly attached to sliding attachment 42. Of course, in some embodiments, sliding attachment 42 need not be moveable relative to support so that the position of the targets 40,56,58 is fixed and not moveable by a user. This embodiment may be attractive for use with a particular size goal for standardization such as if soccer games are played with this invention. Opposing teams could then play against each other under similar circumstances.

Figure 5:
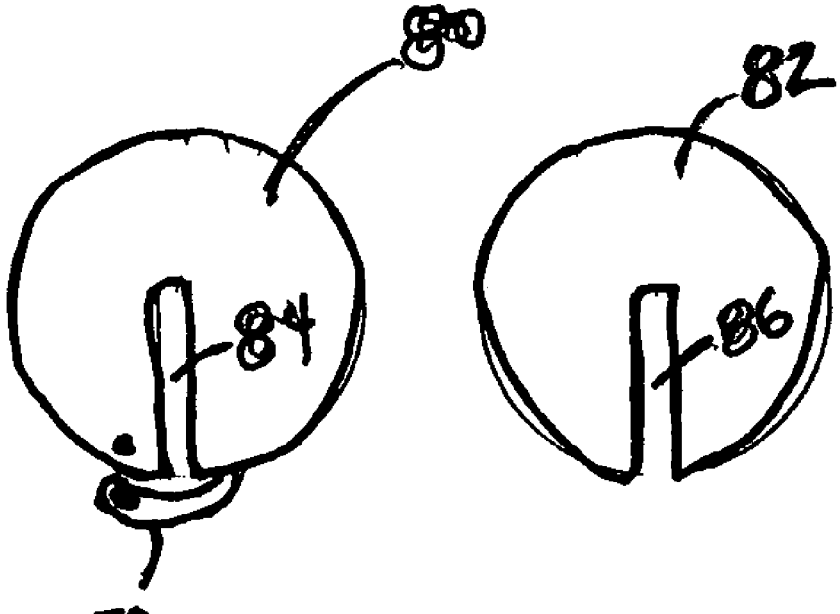
FIG. 5 shows a disassembled version of the target shown in FIG. 4.

FIG. 4 shows a detail of the target 58. The target 58 is supported by elastic member 44 which connects to strap 78 or other appropriate location relative to the target 58. The target 58 is preferably constructed in two portions as shown in FIG. 5, first portion 80 and second portion 82 which have cut outs 84,86. The cut outs 84,86 are oriented towards one another and then the two portions 80,82 are pushed towards each other to form the target 58 as shown in FIG. 4. The strap 78 can then be attached as shown in FIG. 4 to prevent inadvertent disassembly of the target 58. Other targets may be constructed in other ways known in the art. Other three-dimensional targets or two-dimensional target 40 may be utilized having various shapes, sizes and color combinations.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A method of using a targeting aid in combination with a goal having opposing uprights and crossbar defining an area of a goal plane, and a base extending rearwardly relative to a playing field spaced from and behind the uprights and crossbar, said targeting aid comprising a first connector, said first connector configured to selectively connect to an upper cross bar of a goal;

a linear support operably coupled to and extending downwardly and rearwardly relative to the first connector;

a second connector operably coupled to the support, said second connector configured to selectively connect to a rearward base of a goal; and a target connected to the support, said target wider than the support, and said method comprising:

the step of installing the first connector to the upper cross bar of the goal and the second connection to a rearward base of a goal with the target spaced a distance from the first connector and located completely behind a goal plane defined by an area including opposing uprights and crossbar when installed with the linear support extending linearly intermediate the upper cross bar and the rearward base of the goal and having an attachment, said attachment connected to the support and positionable at various positions intermediate the first and second connectors, and further comprising the step of elevationally adjusting the target with the attachment behind the goal plane.

2. The method of using the targeting aid of claim 1 wherein the support is a strap and after the installation step, the strap extends intermediate the first and second connectors.

3. The method of using the targeting aid of claim 2 further comprising an attachment, said attachment connected to the strap and positionable at various positions intermediate the first and second connectors, and further comprising the step of elevationally adjusting the target with the attachment below the goal plane.

4. The method of using targeting aid of claim 1 wherein the target is supported by a vertically and downwardly extending member from the support and after the step of installing the target, the target is spaced by the vertically and downwardly extending member from the support.

5. The method of using the targeting aid of claim 4 further comprising the step of providing the member as an elastic member.

6. The method of using the targeting aid of claim 1 further comprising the step of providing the target as one of a two dimensional target and a three dimensional target.

7. The method of using the targeting aid of claim 6 further comprising and the step of providing an advertising logo on the target.

8. The method of using the targeting aid of claim 6 further comprising the step of providing perpendicularly oriented portions forming a three dimensional target.

9. The method of using the targeting aid of claim 8 wherein the portions further comprise cooperating slots and further comprising the step of connecting the slots to form the three dimensional target.

10. The method of using the targeting aid of claim 1 wherein the first connector further comprises a hook connected to a rigid extension and during the step of installation the hook is utilized in connecting the first connector to the upper cross bar.

11. A method of using a targeting aid in combination with a goal having opposing uprights and crossbar defining an area of a goal plane, said targeting aid comprising:

a first connector, said first connector configured to selectively connect to an upper cross bar of a goal;

a support operably coupled to and extending downwardly and rearwardly relative to the first connector;

a second connector operably coupled to the support, said second connector configured to securely retain the support to extend downwardly and rearwardly of a goal plane defined by an area including opposing uprights and crossbar when installed;

a target connected to the support by a downwardly extending vertical member with the target being wider than the support;

said method comprising the steps of connecting the first connector to the upper cross bar and securing the second connector behind the goal plane thereby locating said target spaced a distance behind the goal plane wherein said target is connected to the support and positionable at various positions intermediate the first and second connectors, and further comprising the step of elevationally adjusting the target with the attachment behind the goal plane.

12. The method of using the targeting aid of claim 11 further comprising the step of directly connecting the second connector to the support.

13. The method of using the targeting aid of claim 12 wherein upon connecting the first and second connector the support is provided as a linear support.

14. The method of using the targeting aid of claim 13 further comprising the step of providing the support as a strap.

15. The method of using the targeting aid of claim 11 further comprising the step of providing an attachment connected to the support, said attachment positionable at various positions intermediate the first and second connectors when connected to the support, and further comprising the step of elevationally adjusting of the target using the attachment.

16. The method of using the targeting aid of claim 11 further comprising the step of providing a downwardly and vertically extending member as an elastic member connected to the support.

17. The method of using the targeting aid of claim 11 further comprising the step of providing the target as one of a two dimensional and a three dimensional target.

18. The method of using the targeting aid of claim 17 further comprising the step of providing the target is as first and second perpendicularly oriented portions.

19. The method of using the targeting aid of claim 18 further comprising the step of providing the first and second portions with cooperating slots and further comprising the step of connecting the slots to form the three dimensional target.

* * * * *